US009981397B2

(12) United States Patent
Calvert et al.

(10) Patent No.: US 9,981,397 B2
(45) Date of Patent: May 29, 2018

(54) CUTTING KNIFE

(71) Applicants: Sean G. Calvert, Walla Walla, WA (US); Robert E. Jones, College Place, WA (US); Brian D. Lovgren, Walla Walla, WA (US); Louis D. Jausoro, Walla Walla, WA (US)

(72) Inventors: Sean G. Calvert, Walla Walla, WA (US); Robert E. Jones, College Place, WA (US); Brian D. Lovgren, Walla Walla, WA (US); Louis D. Jausoro, Walla Walla, WA (US)

(73) Assignee: Key Technology, Inc., Walla Walla, WA (US)

( * ) Notice: Subject to any disclaimer, the term of this patent is extended or adjusted under 35 U.S.C. 154(b) by 63 days.

(21) Appl. No.: 14/543,449

(22) Filed: Nov. 17, 2014

(65) Prior Publication Data

US 2016/0136829 A1 May 19, 2016

(51) Int. Cl.

| | |
|---|---|
| ***B26D 1/00*** | (2006.01) |
| ***B26D 1/06*** | (2006.01) |
| ***B26D 1/42*** | (2006.01) |

(52) U.S. Cl.

CPC ..... *B26D 1/0006* (2013.01); *B26D 1/06* (2013.01); *B26D 1/42* (2013.01); *B26D 2001/006* (2013.01); *Y10T 83/4705* (2015.04); *Y10T 83/4812* (2015.04)

(58) Field of Classification Search

CPC ..... Y10T 83/4812; Y10T 83/4705; Y10T 83/4815; Y10T 83/896; B26D 1/42; B26D 1/425; B26D 1/006; B26D 1/62; B26D 2001/006

USPC ..... 83/337–338, 303, 649

See application file for complete search history.

(56) References Cited

U.S. PATENT DOCUMENTS

| | | | |
|---|---|---|---|
| 3,543,035 | A | 11/1970 | Raye et al. |
| 4,520,702 | A | 6/1985 | Davis et al. |
| 5,029,504 | A | 7/1991 | Wilbur et al. |
| 5,235,880 | A | 8/1993 | Wilbur et al. |
| 2004/0094006 | A1 | 5/2004 | McGarvey et al. |
| 2012/0266730 | A1 | 10/2012 | Jones et al. |

OTHER PUBLICATIONS

PCT/US2015/056604, PCT Search Report dated Jan. 11, 2016.

*Primary Examiner* — Laura M Lee
(74) *Attorney, Agent, or Firm* — Randall Danskin P.S.

(57) ABSTRACT

An inspection and cutting apparatus which employs a reciprocally moveable cutting knife includes an elongated main body having opposite ends; and a protrusion is integral with the elongated main body, and which inhibits an adhesive force from being created between the outside facing surface of the elongated main body, and the adjacent sidewalls of a knife guidance track when a source of water wets the outside surface of the elongated main body and the adjacent spaced sidewalls of the knife guidance channel.

20 Claims, 5 Drawing Sheets

CUTTING KNIFE

TECHNICAL FIELD

The present invention relates to a cutting knife which is employed with equipment for detecting defects in elongated articles or other objects of interest, and for cutting or otherwise removing the defects from the articles or objects of interest as the articles are being processed in a high output production facility.

BACKGROUND OF THE INVENTION

The present invention as disclosed in the paragraphs which follow is utilized in an inspection and cutting apparatus such as what is shown in U.S. Pat. No. 4,520,702. The contents and teachings of this previous patent is incorporated by reference herein. U.S. Pat. No. 4,520,702 addressed a perceived problem then existing in the industry relative to the processing of elongated articles such as sliced potatoes which are utilized for frozen french fries, and wherein the elongated articles were first aligned in moveable, transversely spaced lanes, and then passed beneath individual lane oriented electro-optical cameras for inspecting the french fries for defects. In the previous prior art arrangements, if defects were detected one or more knives on a rotating cutting wheel was projected or propelled from the cutting wheel to cut or sever the defect from the article. Various U.S. patents such as U.S. Pat. No. 3,543,035 describe such earlier devices. Still further, U.S. patent application Ser. No. 13/066,790, and which was filed on Apr. 24, 2011 also describes an improved device for achieving the results described, above. The prior art as shown in U.S. Pat. No. 4,520,702 has been widely embraced by the food processing industry, and has operated with a great deal of success over the years.

While the apparatus as described in this prior art patent has operated quite reliably for several decades, there have been perceived shortcomings which have detracted from its usefulness. Chiefly, two perceived shortcomings have become evident through the continued use of the earlier mentioned apparatus. Firstly, and only occasionally, individual cutter knives employed in the apparatus as described in the previous patent, when rotated at predetermined operational speeds, occasionally would prematurely move or be ejected to a radially outwardly extended cutting position and then engage the elongated food product being processed without being intentionally deployed or actuated by the cutting apparatus. This premature deployment, or movement of a cutting knife to the radially extended cutting position could occasionally cause the knife to become damaged. In addition to the foregoing, the cutting knives employed, to date, have been fabricated from various materials and due to normal wear and tear, and routine operating conditions, such prior art cutting knives have occasionally broken, and have needed to be replaced. This type of wear related failure is typically expected, from time-to-time, in devices of this type. However, depending upon the product to be inspected and cut, the replacement of these damaged cutting knives can sometimes be time consuming, and inconvenient during typical food processing operations. Still further, another problem attendant with the prior art devices, as utilized heretofore, is that, on occasion, such cutting knives have not deployed at all in view of an adverse amount friction or other conditions existing within an associated knife guidance track which defines the path of travel for the individual cutting knives.

While various solutions have been suggested to address the foregoing problems, the premature deployment or the failure to deploy a cutting knife during routine food processing operations has been perceived to be a problem which has not found an acceptable solution.

Therefore, one object of the present invention is to provide a cutting knife which avoids the detriments associated with the individual prior art references while providing the benefits associated therewith.

SUMMARY OF THE INVENTION

A first aspect of the present invention relates to a cutting knife which includes an elongated, main body having opposite first and second ends, and wherein the second end of the main body defines a sharpened edge, and wherein the elongated main body further has an outside facing surface, and is reciprocally moveable within a knife guidance track which has spaced sidewalls for defining a predetermined path of travel for the elongated main body, and wherein a preponderance of the outside facing surface of the elongated main body is oriented in substantially the same plane, and wherein the outside facing surface of the elongated main body, and the knife guidance track are exposed to a source of water, and a protrusion which is defined by the elongated main body extends outwardly from the plane which is defined by the outside facing surface, and further creates a space between the elongated main body and the spaced sidewalls of the knife guidance track, so as to inhibit an adhesion which is created between the outside facing surface of the elongated main body, and the respective sidewalls of the knife guidance track, when the source of water wets the outside surface of the elongated main body, and the spaced sidewalls of the knife guidance channel.

Another aspect of the present invention relates to a cutting knife which includes an elongated main body having a first end, and a foot shaped, second end, and wherein the second end has an outwardly facing, sharpened edge for engaging and severing an object of interest, and wherein the elongated main body is received within, and reciprocally moveable relative to a rotatably moveable knife guidance track, and wherein the elongated main body has an outside facing surface of which a preponderance of the outside facing surface area of the elongated main body lies in the same plane; a movement limiting member which is made integral with the elongated main body, and which cooperates with the rotatably moveable knife guidance track, and which further extends laterally, outwardly from the elongated main body, and wherein the movement limiting member is located intermediate the first and second ends of the elongated main body, and is further oriented within the same plane as the outside facing surface of the elongated main body; and a protrusion which is made integral with the elongated main body extends outwardly therefrom, and in a direction which is out of the plane of the elongated main body, and which further cooperates with the rotatably moveable knife guidance track.

These and other aspects of the present invention will be described in greater detail hereinafter.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article I, Section 8).

Figure 9:
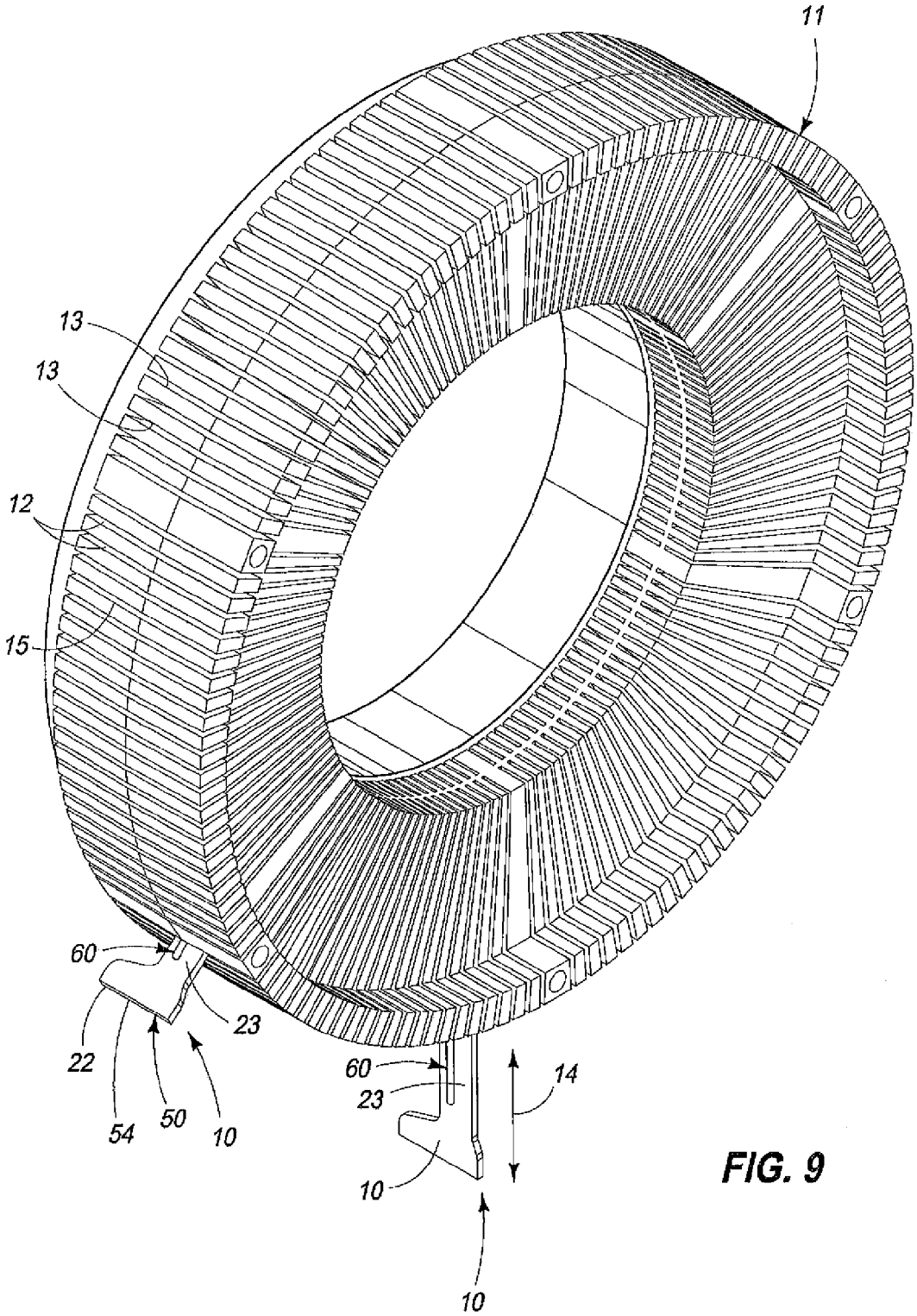
FIG. 9 is a partial, perspective, side elevation view of a rotatable knife support ring which utilizes the cutting knives of the present invention.

Referring now to FIG. 9, it will be seen that the cutting knife of the present invention, and which is generally indicated by the numeral 10 is utilized, in combination with, a rotatable knife support ring which is generally indicated by the numeral 11. The rotatable knife support ring 11 is mounted on an inspection and cutting apparatus as seen in U.S. Pat. No. 4,520,702. The rotatable knife support ring 11 defines a multiplicity of radially extending, individual, knife guidance tracks 12. The individual knife guidance tracks 12 are each defined by a pair of spaced, substantially parallel sidewalls which are indicated by the numeral 13. The spaced sidewalls define, at least in part, a reciprocal path of travel 14 for the individual cutting knives 10, as seen in FIG. 9. The respective cutting knives 10 are moveable from a first, non-cutting position 15, to a second, extended, cutting position 16. In the extended cutting position 16, the cutting knives 10 are brought into contact with an article or object of interest, not shown, in order to sever the object or article in a predetermined location so as to remove a defect which has been previously detected.

Figure 1:
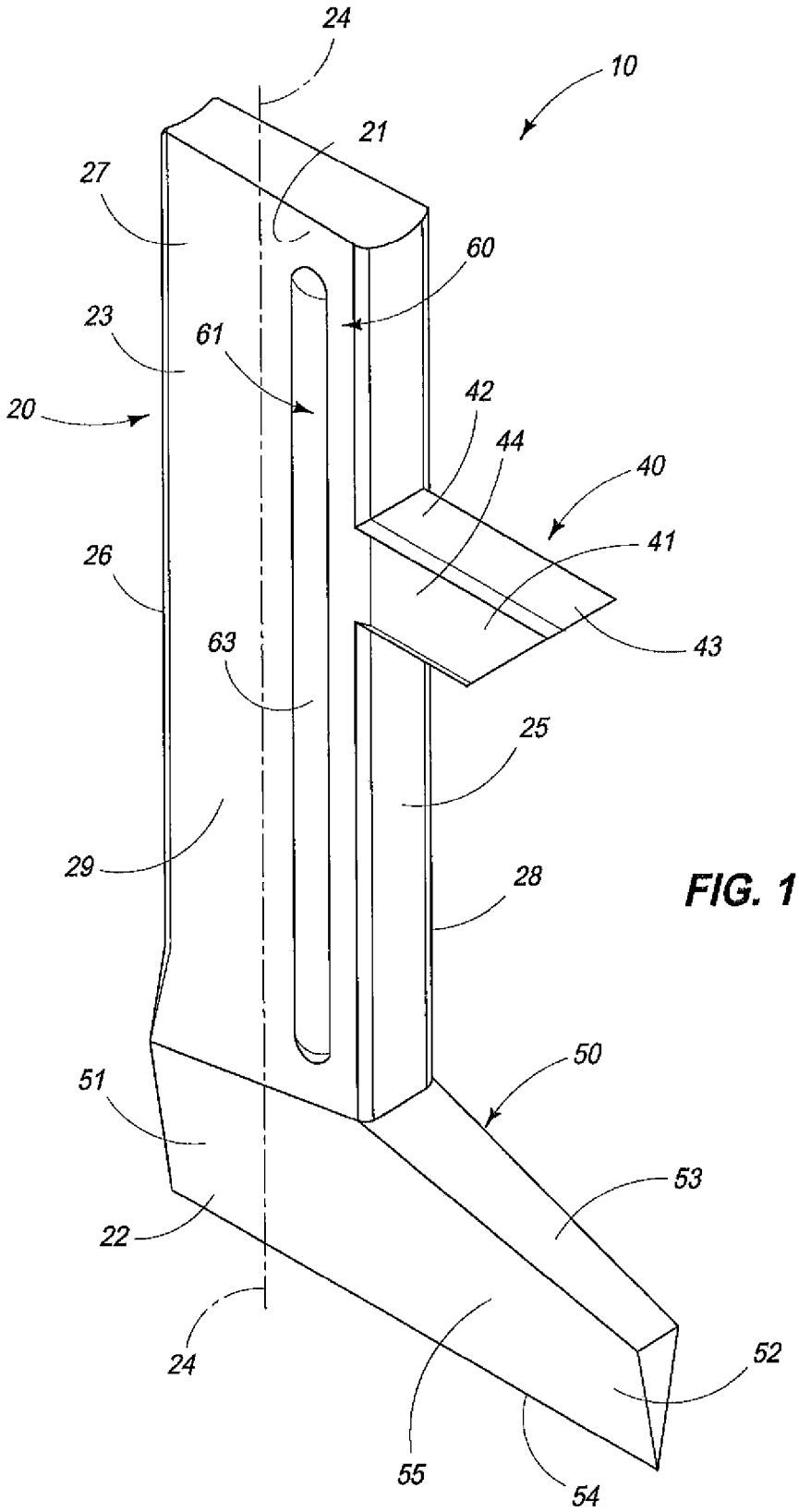
FIG. 1 is a perspective, side elevation view of a first form of a cutting knife which incorporates the features of the present invention.

Referring now to FIG. 1 and following, the first form of the cutting knife 10 as seen in FIG. 1 includes an elongated main body which is generally indicated by the numeral 20. The elongated main body has a first end 21, and an opposite second end 22. The elongated main body is defined, in part, by a shaft portion which is indicated by the numeral 23. The shaft portion 23 is further defined, in part, by a longitudinal axis 24. The longitudinal axis 24 extends between the first and second ends 21 and 22, respectively. Still further the shaft portion has a first longitudinally extending peripheral edge 25; and a second, opposite, longitudinally extending peripheral edge 26. The shaft portion 23 has a given width dimension which is measured between the first and second peripheral edges 25 and 26. Still further the shaft portion 23 has a given length dimension, and a given thickness dimension. Additionally, the shaft portion 23 has opposite sidewall surfaces 27 and 28, and which further define an outside facing surface 29. As illustrated in the drawings, a preponderance of the outside facing surface 29 of the elongated main body 20 is oriented in substantially the same plane. This feature will be discussed in greater detail, hereinafter. As seen in the drawings, the cutting knife 10 of the present invention includes a movement limiting member which is generally indicated by the numeral 40. The movement limiting member 40 is made integral with the elongated main body 20 of the cutting knife 10, and is further positioned in a location which is intermediate the first and second ends 21 and 22 of the reciprocally moveable cutting knife 10. The movement limiting member 40 has a main body 41 with a first end 42, which is made integral with the first peripheral edge 25, and an opposite, second end 43. The main body 41 is defined by an outside facing surface 44, which is oriented in substantially the same plane as the outside facing surface 29, and which further defines the shaft portion 23. The movement limiting member 40 is operable to cooperate with the rotatable knife support ring 11, and the individual knife guidance tracks 12 that are defined by the knife support ring 11, in a manner so as to define the reciprocal path of travel 14 for the individual cutting knives 10 when employed in an operational, automatic defect removal machine, not shown.

The second end 22 of the elongated main body defines a foot-shaped cutting portion which is generally indicated by the numeral 50. The foot-shaped cutting portion has a first end 51, which is substantially aligned with the longitudinal axis 24 of the elongated main body 20, and an opposite, and distal second end 52, and which is positioned laterally, outwardly relative to both the longitudinal axis 24, and the first peripheral edge 25. The foot-shaped cutting portion has a first, or top peripheral edge 53, and an opposite, cutting, or second peripheral edge 54. The second or cutting peripheral edge 54 is operable to engage an object of interest (not shown) and sever the object in a manner which is well known in the art. The foot-shaped cutting portion 50 is transversely disposed relative to the longitudinal axis 24, and extends laterally, outwardly, relative to the shaft portion 23. Again, the second or foot-shaped cutting portion 50 has an outside facing surface 55, and wherein a preponderance of the outside facing surface 55 is angled from the outside facing plane of the shaft, to the cutting edge 24, and which is defined by the foot-shaped cutting portion 50. As seen in FIG. 1, and following, the foot-shaped cutting portion 50 has a length dimension, as measured between the first and second ends 51 and 52, thereof, and which is greater than the width dimension of the elongated main body 20, when this dimension is measured between the peripheral edges 25 and 26 thereof. Still further, the foot-shaped cutting portion 50 has a width dimension as measured between the first and second peripheral edges 53 and 54 which is variable. Further the cutting portion 50 has a variable thickness dimension, (FIG. 1).

Figure 3:
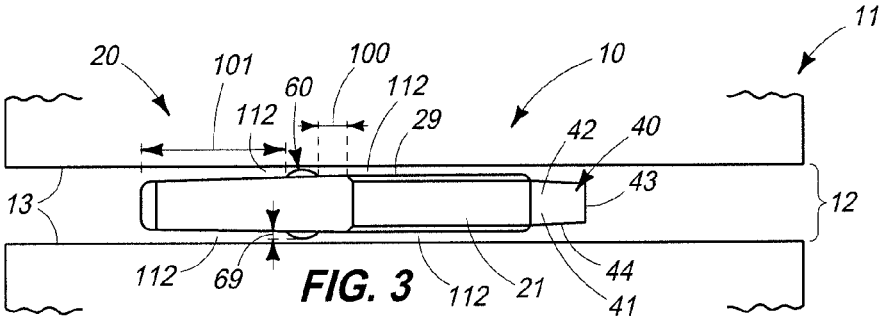
FIG. 3 is a top, plan, end view of a cutting knife which has the features of the present invention as seen in FIG. 1.
Figure 2:
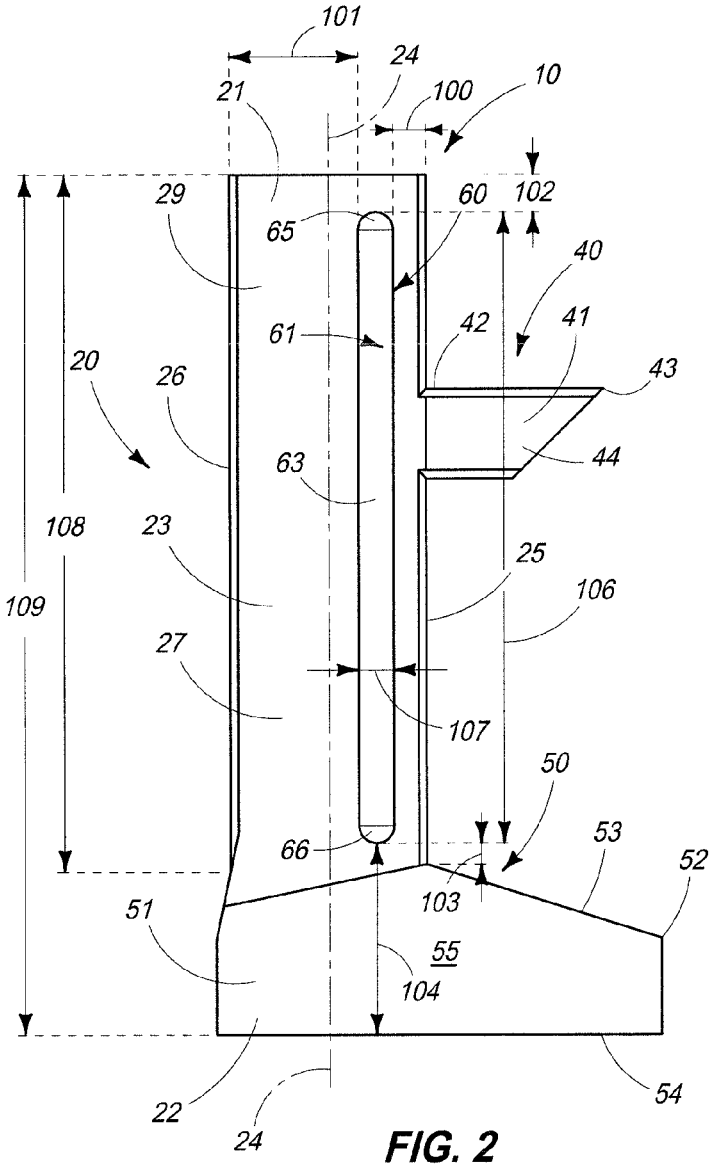
FIG. 2 is a side elevation view of a cutting knife which incorporates the features of the present invention as seen in FIG. 1.
Figure 4:
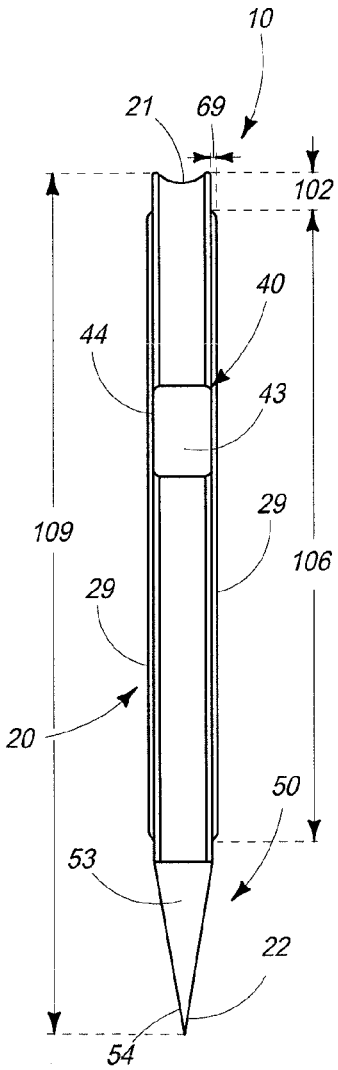
FIG. 4 is an edge, side elevation view of a cutting knife having the features of the present invention as seen in FIG. 1.
Figure 5:
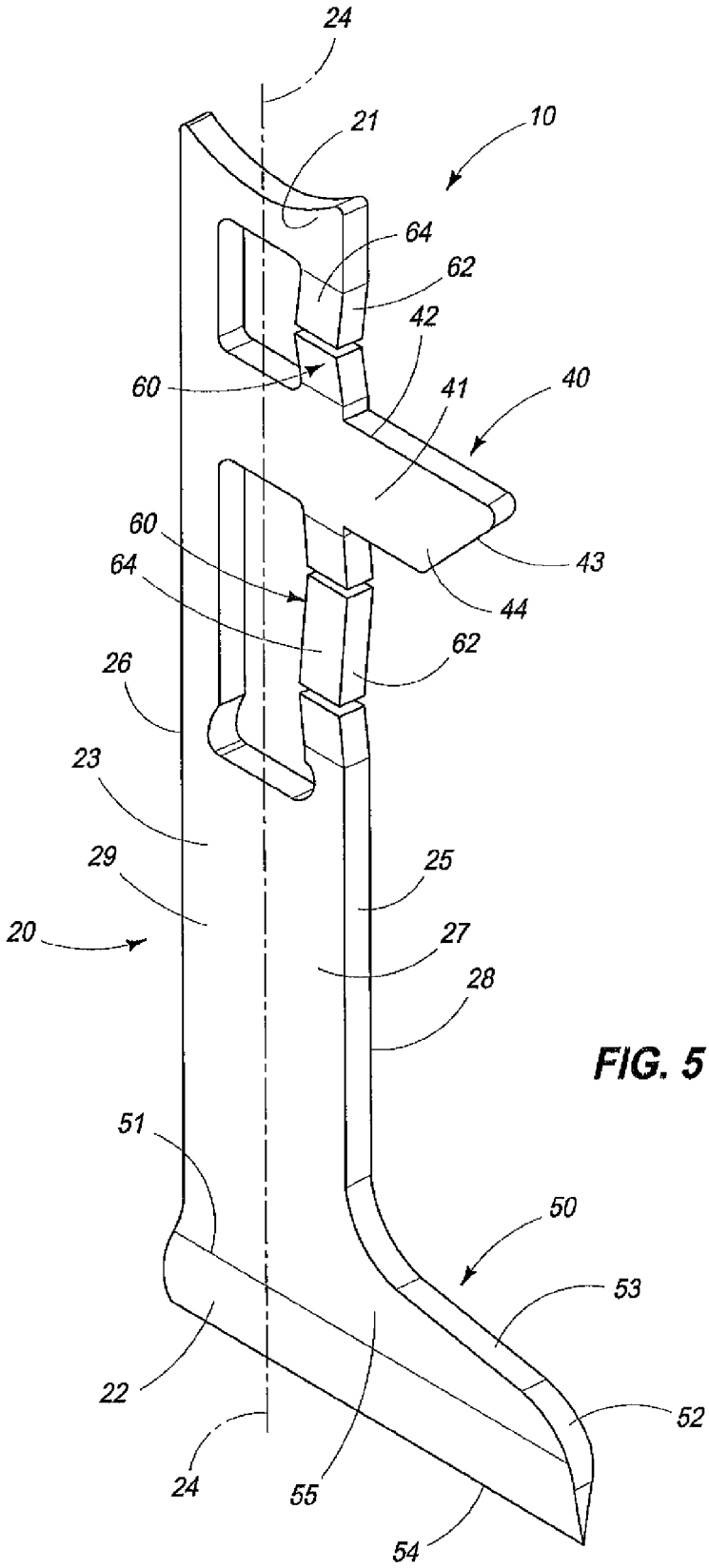
FIG. 5 is a perspective, side elevation view of a second form of a cutting knife having the features of the present invention.
Figure 7:
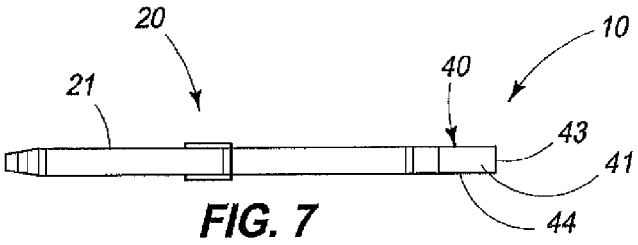
FIG. 7 is a top, plan, end view of a second form of a cutting knife having the features of the present invention.
Figure 6:
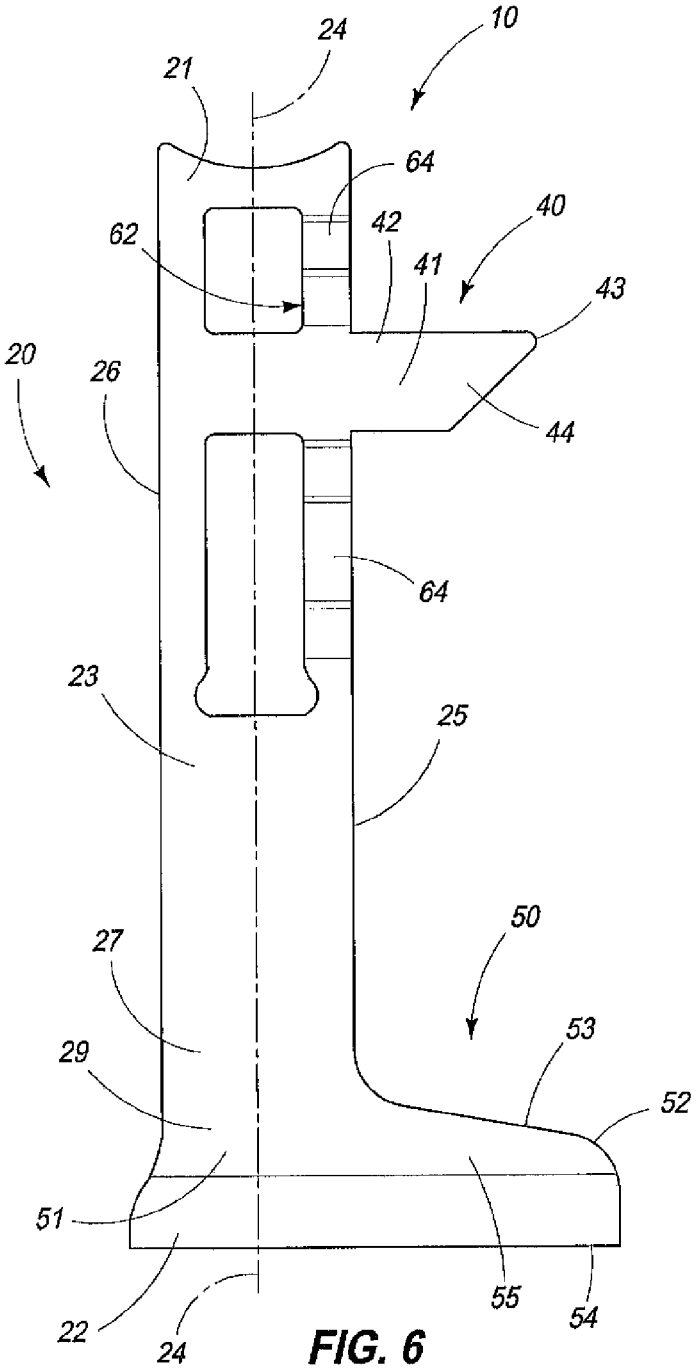
FIG. 6 is a side elevation view of a second form of a cutting knife having the features of the present invention.
Figure 8:
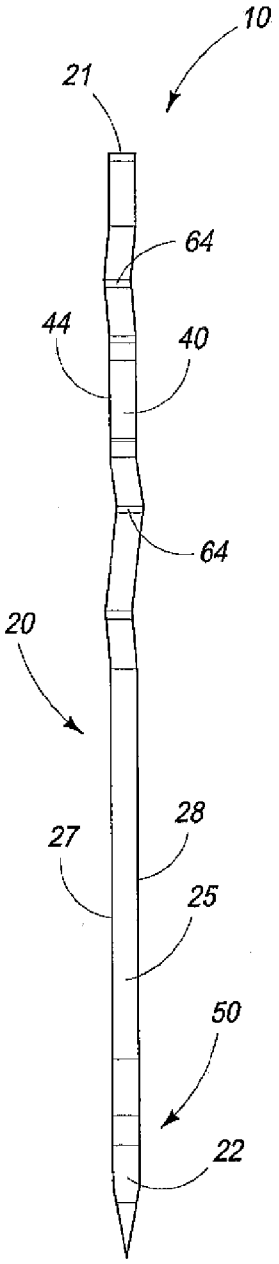
FIG. 8 is an edge, side elevation view of a second form of a cutting knife having the features of the present invention.

As seen in the drawings, the cutting knife 10 of the present invention includes a convexly shaped protrusion which is generally indicated by the numeral 60. The protrusion 60 extends outwardly from the plane which is defined by the outside facing surface 29. The protrusion 60 creates a space extending entirely thereabout between the elongated main body 20, and the spaced generally parallel sidewalls 13 of the knife guidance track 12 so as to inhibit adhesion which is created between the outside facing surface 29 of the elongated main body 20, and the respective sidewalls 13 of the guidance track 12, when water wets the outside surface 29 of the elongated main body 20, and the spaced sidewalls 13 of the knife guidance track 12 during operation of the cutting apparatus. As should be understood, the rotatable knife supporting ring 11 which defines the plurality of radially extending individual knife guidance tracks 12, is often utilized in wet conditions, and in devices which are used to process food products. The water has often been previously used for either transporting the goods, or on the other hand, has been used for washing the goods or articles before they were transported and during the sorting and cutting process. Consequently, this source of water, not shown, often becomes deposited on the outside facing surface 29 of the elongated main body 20, and within the plurality of individual knife guidance tracks 12. As will be appreciated, the respective cutting knifes 10 are typically forced to travel rapidly along the reciprocal path of travel 14. During normal operations the knife guidance track 12 utilizes the deposited water to retain the respective cutting knives 10 in their first retracted and non-cutting position 15 when the rotatable knife support ring 11 is rotating at its operating speed. It should be understood that the surface wetting between the respective cutting knives 10, and the adjacent space sidewalls 13, in combination with static friction, creates a retention force which is usually greater than the centrifugal force experienced by the cutting knives 10 as the knife supporting ring 11 rotates. As will be appreciated, and during operation the cutting knives 10 are exposed to an intentional and predetermined ejection force, (not shown) which is typically caused by high pressure fluid (air and water, for example), and which overcomes the adhesion caused by the wetting and the friction, to cause the cutting knives 10 to travel along the knife guidance track 12, and along the path of travel 14. However, during operation, friction generated between the individual cutting knives 10, and the adjacent sidewalls 13 has, heretofore, caused the outside facing surfaces 29 of the elongated main body 20 to become smooth. At this point, the surface wetting, and the resulting adhesion, caused by the presence of water on the individual smooth surfaces is not overcome by the actuation force provided by the high pressure air which is supplied, and consequently the previous prior art knives have failed to actuate, or even travel the full distance along the reciprocal path of travel 14. In the arrangement as provided in the present invention, the convexly shaped protrusions 60 inhibit an adhesion force from being created between the outside facing surface 29 of the elongated main body 20, and the respective adjacent sidewalls 13 of the knife guidance track 12 when the water wets the outside surface 29 of the elongated main body 20, and the spaced sidewalls 13, respectively. This is achieved when the protrusion 60 frictionally contacts at least one of the sidewalls 13 of the knife guidance channel or track 12, thereby creating a space that extends entirely about the protrusion 60, and thus preventing the water from creating an adhesion force which cannot be overcome by the actuation force causing the cutting knife 10 to move along the path of travel 14. As seen in the drawings, the protrusion 60 includes a first form 61, as seen in FIG. 1; and a second form 62 as seen in FIG. 5. In the first form, each protrusion 61 includes a continuous, narrowly elongated convexly shaped body 63, and which extends outwardly, a known thickness dimension 69 relative to the outside facing surface 29, and in a direction which is outside the plane as defined by the outside facing surface 29 of the elongated main body 20. Each protrusion 60 extends outwardly relative to each side 29 of the elongated main body 20. In the second form 62, (FIG. 5) the protrusion 60 may include a plurality of protrusions 64, and which are oriented in predetermined locations along the first peripheral edge 25 of the elongated main body 20 (FIG. 5). As seen in FIG. 1, the first form 61 of the protrusion 60, and which forms the elongated continuously narrow convexly shaped body 63 has a first end 65, a spaced apart second end 66, a first elongate edge 67, a spaced apart second elongate edge 68 and a length dimension 106. Protrusion 60 is formed on each opposing side of the shaft portion 23 of the elongated main body 20. The first end 65 of the protrusion 60 is spaced a distance 102 away from the first end 21 of the elongate main body 20. The second end 66 of the protrusion 60 is spaced a distance 103 away from the foot shaped cutting portion 50. The first elongate edge 67 of the protrusion 60 is spaced a distance 100 away from the first longitudinally extending peripheral edge 25 of the elongated main body 20 and the second elongate edge 68 of the protrusion 60 is spaced a distance 101 away from the second longitudinally extending peripheral edge 26 of the elongated main body 20. The distances 100, 101, 102 and 103 in combination with the thickness dimension 69 of the protrusion 60 create and maintain a space 110, (See FIG. 3) between the elongated main body 20 and the adjacent side wall 13 of the knife guidance track 12. As shown in the Figures, the space 110 extends entirely about the narrowly elongated convexly shaped body 63 of the protrusion 60. The space 110 inhibits and/or substantially prevents formation of adhesion caused by water between the elongated main body 20 and the adjacent side wall 13 and allows the cutting knife 10 to be reliably deployed into the extended cutting position 16 when actuated.

Operation

The operation of the described embodiments of the present invention are believed to be readily apparent, and are briefly summarized at this point.

The reciprocally moveable cutting knife 10 of the present invention is best illustrated by FIGS. 1 and 5. In its broadest aspect the cutting knife 10 which is used in combination with a rotatable knife support ring 11, and which is mounted on an inspection and cutting apparatus which is similar to that as disclosed in U.S. Pat. No. 4,520,702, includes an elongated main body having opposite first and second ends 21 and 22, respectively, and wherein the second end 22 of the main body 20 defines a sharpened edge 54. The elongated main body 20 further has an outside facing surface 29, and is further reciprocally moveable within a knife guidance track 12 which has spaced sidewalls 13, for defining a predetermined path of travel 14 for the elongated main body 20. A preponderance of the outside facing surface 29 of the elongated main body 20 is oriented in substantially the same plane, and wherein the outside facing surface 29 of the elongated main body, and the knife guidance track 12 are exposed to a source of water. In the arrangement as seen in the drawings, the reciprocally moveable cutting knife 10 has a protrusion 60 which is defined by the elongated main body 20, and which further extends outwardly from the plane which is defined by the outside facing surface 29. The protrusion 60 creates a space between the elongated main body 20, and the spaced sidewalls 13, which define the knife guidance track 12, and which further inhibits an adhesion from being created between the outside facing surface 29 of the elongated main body 20, and the respective sidewalls 13 of the knife guidance track 12 when the source of water wets the outside surface 29 of the elongated main body 20, and the spaced sidewalls 13 of the knife guidance channel 12.

The elongated main body 20 is defined, at least in part, by a shaft portion 23. The shaft portion 23 has a predetermined length dimension, and further extends from the first end 21 of the elongated main body 20, and in the direction of the second end 22 thereof. The shaft portion 23 is defined, at least in part, by a longitudinal axis 24. In the arrangement as seen in the drawings, the path of travel 14 of the reciprocally moveable cutting knife 10 is substantially coaxially with, and parallel to the longitudinal axis 24 of the shaft portion 23.

The second end 22 of the elongated main body 20 includes a cutting portion 50 having a first and second end 51 and 52, respectively. The cutting portion 50 is disposed substantially transversely relative to the longitudinal axis 24 of the shaft portion 23, and is further located substantially along the longitudinal axis 24 of the shaft portion 23. The cutting portion 50 has an outside facing surface 55 which is angled from the outside facing plane, as defined by the outside facing surface 29, to the cutting edge 24, as defined by the foot-shaped cutting portion 50. As seen in the drawings, the cutting knife 10 includes a movement limiting member 40 which is made integral with the elongated main body 20, and which is further positioned in a location which is intermediate to the first and second ends 21 and 22, of the reciprocally moveable cutting knife 10. The movement limiting member 40 has an exterior facing surface 44 which is oriented in the same plane as the elongated main body 20.

In the arrangement as seen in the drawings, the reciprocally moveable cutting knife 10 as illustrated includes a shaft portion 23, and which has opposite first and second peripheral edges 25 and 26 respectively, and which are further oriented in substantially parallel, spaced relation, one relative to the other. The movement limiting member 40, and the second end 52, of the cutting portion 50, each extend laterally outwardly relative to the first peripheral edge 25 of the shaft portion 23. The movement limiting member 40, and the cutting portion 50 are positioned in spaced relation, one relative to the other. The cutting portion 50 has a variable width dimension when the same width dimension is measured between the first and second ends 51 and 52 thereof. In the arrangement as seen in the drawings, the protrusion 60 comprises, in one form, a continuous narrowly elongated body 63 which is located in parallel relation relative to the first peripheral edge 25. The first peripheral 25 has a predetermined length dimension, and the protrusion 60 has a length dimension which is less than the length dimension of the first peripheral edge 25. As illustrated in the drawings, the protrusion 60 may also comprise a plurality of protrusions 64 which are oriented in predetermined locations along the first peripheral edge 25 of the shaft portion 23.

As seen in FIG. 1, the shaft portion 23 has a continuous outside facing surface 29 as illustrated. In the second possible form of the invention as seen in FIG. 5, the shaft portion 23 has a discontinuous outside facing surface 29. More specifically, several apertures are positioned or formed along the shaft portion 23. In the arrangement as seen in the drawings, it should be understood that the elongated main body 20 may be fabricated from a metal substrate, or from a synthetic substrate or further, from a combination of both metal and synthetic materials.

Therefore it will be seen that the present cutting knife avoids the detriments individually associated with using cutting knives of the previous design and further provides a convenient means for assembling a food processing device which is operable to reliably actuate predetermined cutting knives in a very reliable manner not possible heretofore.

In compliance with the statute the invention has been described in language more or less specific as to structural and methodological features. It is to be understood, however, that the invention is not limited to the specific features shown and described, since the means herein disclosed compromise preferred forms of putting the invention into effect. The invention is, therefore, claimed in any of its forms or modifications within the proper scope of the appended claims appropriately interpreted in accordance with the Doctrine of Equivalence.

We claim:

1. An inspection and cutting apparatus, comprising:

a rotatable knife supporting ring having a multiplicity of radially aligned knife guidance tracks, and each of said multiplicity of radially aligned knife guidance tracks are defined by opposing, generally parallel, spaced apart sidewalls;

a reciprocally movable cutting knife reciprocally and moveably cooperates with one of said knife guidance tracks, and wherein the cutting knife has an elongated, main body having opposite first and second ends, two opposing sides, and opposite first and second peripheral edges, and wherein the second end of the main body defines a sharpened edge, and wherein the elongated main body further has an outside facing surface on each opposing side, and wherein a majority of the outside facing surface on each opposing side of the elongated main body is oriented in substantially the same plane, and wherein the outside facing surfaces of the elongated main body, and the knife guidance tracks are exposed to a source of water during operation of the inspection and cutting apparatus; and a convexly shaped protrusion integral with each opposing side of the elongated main body and extending parallel to the first and second peripheral edges of the elongated main body and each protrusion has a length dimension that is less than a length dimension of the elongated main body and further having a first end that is spaced apart from the first end of the elongated main body, a second end that is spaced apart from the second end of the elongated main body, a first elongate edge that is spaced apart from the first peripheral edge of the elongated main body and a second elongate edge that is spaced apart from the second peripheral edge of the elongated main body and each convexly shaped protrusion further has a thickness dimension that causes each said protrusion to extend outwardly from the outside facing surface of the elongated main body beyond the plane of the outside facing surface; and each convexly shaped protrusion frictionally engages with an adjacent one of the opposing generally parallel spaced apart sidewalls of one of the multiplicity of said knife guidance tracks and maintains a space between the outside facing surface of the elongated main body and the said adjacent sidewall of the said knife guidance track so as to inhibit adhesion which is created between the outside facing surface of the elongated main body, and the said respective sidewalls of the said knife guidance track, when water wets the outside surface of the elongated main body, and the said spaced sidewalls of the said knife guidance track.

2. An inspection and cutting apparatus as claimed in claim 1, and wherein the elongated main body of the reciprocally moveable cutter knife is defined, at least in part, by a shaft portion which has a first longitudinally extending peripheral edge and a spaced apart and parallel second longitudinally extending peripheral edge, and wherein the shaft portion has a predetermined length dimension, and further extends from the first end of the elongated main body, and in the direction of the second end thereof, and wherein the length dimension of the convexly shaped protrusion between the first end portion and the second end portion thereof is less than the length dimension of the shaft portion, and wherein the shaft portion further is defined, at least in part, by a longitudinal axis, and wherein a path of travel of the reciprocally moveable knife is defined by the spaced sidewalls forming the knife guidance track, and wherein the shaft portion is oriented substantially coaxial with the path of travel.

3. An inspection and cutting apparatus as claimed in claim 2, and wherein the second end of the elongated main body includes a cutting portion having a first and a second end, and wherein the cutting portion is disposed substantially transversely relative to the longitudinal axis of the shaft portion, and wherein the cutting portion defines the sharpened edge, and wherein the longitudinal axis of the shaft portion passes through the first end of the cutting portion.

4. An inspection and cutting apparatus as claimed in claim 3, and wherein a movement limiting member that is integral with the elongated main body is further positioned in a location which is intermediate relative to the first and second ends of the elongated main body, and wherein the movement limiting member has an exterior facing surface which is coplanar with the outside surface of the elongated main body.

5. An inspection and cutting apparatus as claimed in claim 4, and wherein the first and second longitudinally extending peripheral edges of the shaft portion are oriented in substantially parallel, spaced relation, one relative to the other, and wherein each of the movement limiting member, and the second end of the cutting portion, extend laterally, outwardly relative to the first longitudinally extending peripheral edge, and wherein the movement limiting member and the cutting portion are positioned in spaced relation, one relative to the other.

6. An inspection and cutting apparatus as claimed in claim 5, and wherein the cutting portion has a variable width dimension when the width dimension of the cutting portion is measured between the first and second ends thereof.

7. An inspection and cutting apparatus as claimed in claim 6, and wherein each protrusion comprises a convexly shaped protrusion intergral with each opposing side of the elongated main body and each of the said protrusions is oriented in a predetermined location spacedly adjacent the first peripheral edge of the elongated main body.

8. An inspection and cutting apparatus as claimed in claim 6, and wherein the shaft portion has a continuous outside facing surface.

9. An inspection and cutting apparatus as claimed in claim 6, and wherein the shaft portion has a discontinuous outside facing surface.

10. An inspection and cutting apparatus as claimed in claim 6, and wherein the elongated, main body is fabricated from a metal substrate.

11. An inspection and cutting apparatus as claimed in claim 6, and wherein the elongated, main body is fabricated from a synthetic substrate.

12. An inspection and cutting apparatus as claimed in claim 6, and wherein the elongated, main body is fabricated in a manner which includes both metal and synthetic materials, and wherein the cutting portion has opposite peripheral edges.

13. An inspection and cutting apparatus as claimed in claim 6, and wherein the cutting portion has a variable thickness dimension when the thickness dimension is measured along a line extending between the opposite peripheral edges thereof.

14. An inspection and cutting apparatus comprising:

a multiplicity of reciprocally movable cutting knives;

a rotatable knife supporting ring mounted on the inspection and cutting apparatus, and having a multiplicity of radially extending knife guidance tracks which are each defined by opposite, spaced apart side walls;

one of said reciprocally moveable cutting knives received within each of the multiplicity of knife guidance tracks respectively, and wherein each of said cutting knives has an elongated main body having a first end, and a foot shaped second end, and wherein the second end has an outwardly facing, sharpened edge for engaging and severing an object of interest, and wherein the elongated main body has two opposing outside facing surfaces, and a majority of each opposing outside facing surface lies in a single plane respectively, and wherein the elongated main body is defined, in part, by opposite, first and second longitudinally extending peripheral edges, and has a predetermined length dimension;

a movement limiting member which is integral with the elongated main body, and which cooperates with the respective knife guidance track, and which further extends laterally, outwardly from one longitudinally extending peripheral edge of the elongated main body, and wherein the movement limiting member is located intermediate the first and second ends of the elongated main body, and is further oriented in a coplanar relationship with the outside facing surface of the elongated main body; and a convexly shaped protrusion integral with each opposing outside facing surface of each of the main bodies, and extending parallel to the first and second longitudinally extending peripheral edges thereof, each protrusion further having a predetermined length dimension that is less than a length dimension of the elongated main body and a first end that is spaced apart from the first end of the elongated main body, a second end that is spaced apart from the foot shaped second end of the elongated main body, a first elongate edge that is spaced apart from the first longitudinally extending peripheral edge and a second elongate edge that is spaced apart from the second longitudinally extending peripheral edge, and each protrusion further has a thickness dimension that causes said protrusion to extend outwardly from the respective outside facing surface of the respective elongated main body so that each protrusion extends outwardly beyond the plane of the respective outside facing surface; and the convexly shaped protrusions frictionally engage with an adjacent generally parallel opposing spaced apart side wall of the respective knife guidance track and maintains a space extending entirely about the protrusions between the outside facing surface of the elongated main body and the adjacent side wall of the respective knife guidance track to reduce adhesion caused by water between the sidewall and the outside facing surfaces of the elongated main body.

15. An inspection and cutting apparatus as claimed in claim 14, and wherein each knife guidance track and the respective spaced apart side walls thereof, and the elongated main body of each reciprocally moveable cutting knife are exposed to a source of water during movement of the elongated main body along the respective knife guidance track, and wherein the convexly shaped protrusion engages at least one of the spaced sidewalls of the knife guidance track and creates and maintains a space between the engaged sidewall, and the elongated main body, so as to impede adhesion from being generated by water between the elongated main body, and the sidewall, and which has the effect of retarding the reciprocal movement of the elongated main body when the water wets the engaged sidewall, and the elongated main body of the reciprocally moveable cutting knife, respectively.

16. An inspection and cutting apparatus as claimed in claim 15, and wherein the elongated main body of each reciprocally movable cutting knife is defined, at least in part, by a shaft portion, and wherein the shaft portion, of each reciprocally movable cutting fitting knife has a predetermined length, a width dimension and a thickness dimension, and which further extends from the first end of the elongated main body, and in the direction of the second end thereof, and wherein the shaft portion further is defined, at least in part, by a longitudinal axis, and wherein a path of travel of each respective reciprocally moveable cutting knife is defined by the spaced sidewalls of the rotatably moveable knife guidance track, and wherein the longitudinal axis of the shaft portion is coaxially aligned relative to the path of travel.

17. An inspection and cutting apparatus as claimed in claim 16, and wherein the width dimension of the shaft portion is measured between the opposite first and second longitudinally extending peripheral edges, and wherein each of the movement limiting member, and second end of the foot shaped second end extend laterally, outwardly relative to the first longitudinally extending peripheral edge, and wherein the movement limiting member and the cutting portion are positioned in spaced relation, one relative to the other, and wherein the foot shaped second end has a length dimension which is measured between the first and second ends thereof, and wherein the width dimension of the shaft portion is less than the length dimension of the second, foot shaped end.

18. An inspection and cutting apparatus as claimed in claim 14, and wherein each protrusion comprises a convexly shaped protrusion integral with each opposing side of each elongated main body and each of the said protrusions is oriented in a predetermined location spacedly adjacent the first peripheral edge of the elongated main body.

19. An inspection and cutting apparatus as claimed in claim 18, and wherein the shaft portion has a discontinuous outside facing surface.

20. A cutting apparatus comprising:

a rotatable knife support ring mounted on the cutting apparatus, the rotatable knife support ring defining a plurality of spacedly arrayed radially extending knife guidance tracks and each track is defined by a pair of opposing generally parallel spaced apart side walls that are exposed to water during operation of the cutting apparatus;

a cutting knife reciprocally movably carried within each knife guidance track and between each pair of the generally parallel spaced apart side walls, the cutting knife having an elongated main body with a shaft portion, a foot shaped cutting portion and a movement limiting member, the elongated main body further having a first end, a second end and two opposing sides, each opposing side having an outside facing surface, and the majority of the outside facing surface extends along a single plane, and the shaft portion of the elongated main body has a first longitudinally extending peripheral edge, and a parallel spaced apart second longitudinally extending peripheral edge and both peripheral edges extend from the first end of the elongated main body toward the second end of the elongated main body, and the foot shaped cutting portion is integral with the shaft portion and at the second end of the elongated main body and has a first end that is aligned with the second longitudinally extending peripheral edge of the shaft portion, and a second end that extends laterally outwardly beyond the first longitudinally extending peripheral edge of the shaft portion opposite the first end, the foot shaped cutting portion further defines a cutting edge opposite the shaft portion, and the foot shaped cutting portion still further has an outside facing surface that is substantially coplanar with the outside facing surface of the elongated main body, and the movement limiting member has a main body with a first end integral with the first longitudinally extending peripheral edge of the shaft portion between the first end of the elongated main body and the foot shaped cutting portion, and a spaced apart second end that extends laterally outwardly beyond the first longitudinally extending peripheral edge of the shaft portion, the movement limiting member further has an outside facing surface that is coplanar with the outside facing surface of the shaft portion and substantially coplanar with the outside facing surface of the foot shaped cutting portion;

a convexly shaped protrusion integral with each opposing side of the elongated main body shaft portion, each protrusion extending parallel to the first and second longitudinally extending peripheral edges of the shaft portion and haying a predetermined length dimension that is less than a length dimension of the shaft portion of the elongated main body and still further having a first end that is spaced apart from the first end of the elongated main body, a second end that is spaced apart from the foot shaped cutting portion, a first elongate edge that is spaced apart from the first longitudinally extending peripheral edge of the shaft portion and a second elongate edge that is spaced apart from the second longitudinally extending peripheral edge of the shaft portion, each protrusion further having a thickness dimension that causes each protrusion to extend outwardly from said respective outside facing surface of the shaft portion of the elongated main body so that each protrusion extends outwardly beyond the plane of said respective outside facing surface; and each convexly shaped protrusion frictionally engages with an adjacent generally parallel opposing spaced apart side wall of the knife guidance track and maintains a space extending between the outside facing surface of the elongated main body and the adjacent side wall of the knife guidance track to reduce adhesion caused by water between the sidewall and the outside facing surface of the elongated main body, and the space extends entirely about the protrusion.

* * * * *